US006705110B1

(12) United States Patent
Worsham

(10) Patent No.: US 6,705,110 B1
(45) Date of Patent: Mar. 16, 2004

(54) BOTTLE CARRIER/COOLER

(76) Inventor: Jack W. Worsham, 1808 Worsham Pl., Greensboro, NC (US) 27408

( * ) Notice: Subject to any disclaimer, the term of this patent is extended or adjusted under 35 U.S.C. 154(b) by 0 days.

(21) Appl. No.: 10/360,415

(22) Filed: Feb. 7, 2003

(51) Int. Cl.[7] ..... F25D 3/08
(52) U.S. Cl. ..... 62/457.4; 62/371; 62/530
(58) Field of Search ..... 62/457.2, 457.4, 62/457.6, 457.8, 530, 371

(56) References Cited

U.S. PATENT DOCUMENTS

| | | | | | |
|---|---|---|---|---|---|
| 81,814 | A | * | 9/1868 | Nuellens et al. | 62/297 |
| 592,781 | A | * | 11/1897 | Hertwig | 220/506 |
| 3,998,072 | A | * | 12/1976 | Shaw | 62/457.4 |
| 4,299,100 | A | * | 11/1981 | Crisman et al. | 62/457.4 |
| 4,671,424 | A | * | 6/1987 | Byrns | 220/592.16 |
| 4,708,254 | A | * | 11/1987 | Byrns | 215/13.1 |
| 4,768,354 | A | * | 9/1988 | Barnwell | 62/457.4 |
| 4,961,324 | A | * | 10/1990 | Allan | 62/400 |
| 5,361,604 | A | * | 11/1994 | Pier et al. | 62/457.4 |
| 5,406,808 | A | * | 4/1995 | Babb et al. | 62/457.4 |
| 5,444,992 | A | * | 8/1995 | Bell | 62/372 |
| 5,555,746 | A | * | 9/1996 | Thompson | 62/457.4 |
| 5,927,085 | A | * | 7/1999 | Waldman | 62/129 |
| 5,983,662 | A | * | 11/1999 | Luetsch | 62/457.4 |
| 6,076,874 | A | | 6/2000 | Lovette | |
| 6,240,741 | B1 | * | 6/2001 | Dozhier | 62/457.3 |
| 6,330,808 | B1 | * | 12/2001 | Kouwenberg et al. | 62/372 |
| 6,385,992 | B1 | | 5/2002 | Flore, Jr. | |
| 6,394,517 | B1 | | 5/2002 | Borg | |

OTHER PUBLICATIONS

Picture of 835–Drink Cooler found on website www.cool-tote.com (undated).
Picture of 2 Liter Bottle Cooler found on website www.i-cycools.com (undated).
Picture of Rusty Wallace 2002 Miller Lite Bottle Cooler Jacket found on website.www.prostar.com (undated).
Picture of Ice Block Bottle Cooler found on website www.kegclub.com (undated).

* cited by examiner

*Primary Examiner*—William C. Doerrler

(57) ABSTRACT

A bottle carrier/cooler is provided for easy, convenient transportation, cooling and storage of a single conventional plastic beverage bottle. The bottle carrier/cooler is configured to substantially contain one standard bottle while exposing the bottle neck and bottle cap. The body of the bottle carrier/cooler is of a diameter sufficient to maintain ice or other refrigerants so the bottled beverage will remain at a desirable low temperature. The beverage which may be a soft drink, can be poured from the bottle without removing the bottle from the carrier/cooler. Finger detents formed within the sidewalls of the carrier/cooler keep the bottle in a radial stable location. A seal connected to the carrier/cooler lid prevents leakage of the refrigerant while the beverage is poured and in conjunction with projections along the bottom of the carrier/cooler stabilize the bottle longitudinally.

14 Claims, 5 Drawing Sheets

BOTTLE CARRIER/COOLER

FIELD OF THE INVENTION

The invention herein pertains to coolers for beverage bottles and particularly pertains to portable drink coolers which utilize ice as a refrigerant.

DESCRIPTION OF THE PRIOR ART AND OBJECTIVES OF THE INVENTION

Portable drink coolers are commonly used to maintain soft drinks and other beverages, food and the like at refrigerated temperatures. Such coolers require ice in a standard form such as cubes and are generally sized to contain six or more 12 ounce beverage cans or several one to two liter beverage bottles with a sufficient quantity of ice. These coolers usually employ pivotable handles and removable lids to completely enclose the beverage containers during transportation and storage. While such coolers are often formed of light weight plastics, when filled they are often heavy, cumbersome and can occupy a relatively large space. In use the lid must generally be opened or removed for the bottle to be removed and the contents poured. Upon bottle removal, the bottles are usually wet and often need to be wiped and dried before handling. Opening and closing the cooler causes the refrigerant to be lost or sometimes spilled which lessens the ability of the refrigerant to properly cool the beverage container.

Thus with the known problems and deficiencies of prior portable beverage coolers and carriers, the present invention was conceived and one of its objectives is to provide a carrier/cooler for a single, standard beverage bottle which is light in weight and which is easy to transport, lift, use and store.

It is another objective of the present invention to provide a beverage carrier/cooler which can be easily opened, loaded with a beverage bottle and ice, and thereafter closed to seal the beverage bottle and ice therein.

It is yet another objective of the present invention to provide a carrier/cooler which is formed from a lightweight plastic which will remain closed while the beverage is dispensed.

It is a further objective of the present invention to provide a carrier/cooler having a pair of finger detents along the sidewalls for gripping and internally for quick and accurate alignment of the beverage container centrally during insertion.

It is still another objective of the present invention to provide a lid for the carrier/cooler body which is threadably received thereon.

It is also another objective of the present invention to provide a flexible handle for the carrier/cooler which is affixed to the lid and which can be fully extended for manual transportation or lowered for packaging and shipping purposes.

It is yet another objective of the present invention to provide a flexible seal for the carrier/cooler which is releasably affixed to the lid for engaging the neck of the beverage bottle to prevent refrigerant liquid contained within the carrier from spilling, for example as the beverage is dispensed.

Various other objectives and advantages of the present invention will become apparent to those skilled in the art as a more detailed description is set forth below.

SUMMARY OF THE INVENTION

A carrier/cooler for a conventional single beverage bottle is provided for convenience and ease in storage, use and transportation. The carrier/cooler includes a body formed from a conventional plastic such as K-resin as manufactured by Phillips Petroleum of Bartlesville, Okla. Although other suitable materials maybe used such as PVC, PET or polycarbonate. A flexible seal formed from an elastomeric material is attached to the lid and a flexible polyethylene or a similar plastic handle is likewise affixed. The lid may also be formed from polypropylene although other suitable polymeric or other materials may be used.

The cylindrical body of the carrier/cooler includes sidewalls joined to a bottom as by integrally blow molding or other standard forming techniques. The threaded lid, also molded from plastic is releasably joined to the exterior threads on the top of the body sidewalls to enclose a beverage bottle and a refrigerant such as ice therewithin. The seal lid and handle may each be formed by injection molding for cost effective manufacturing. One or more internal, upward projections are positioned in a circle along the bottom which engage the bottom of the bottle and in cooperation with the detents in the sidewalls, stabilize and center the bottle during loading and maintain uniform space between the sidewalls and the beverage bottle for ice or other refrigerants. A flexible seal having a large central opening is affixed to the central lid opening. Whereby the lid is then threadably joined to the body proximate the neck of the beverage bottle. The seal engages the bottle neck or shoulder as the lid is tightened onto the body and prevents any spillage of refrigerant should the carrier/cooler be tipped over, such as during pouring from the beverage bottle. The pair of finger detents in the sidewalls of the body also serve as finger grips to allow the carrier/cooler to be securely held for pouring and handling. In addition to the two finger detents in the body, a smaller, conical detent along the inner circumference of the body acts as a third point to stabilize the bottle radially, whereas the lid seal and bottom projections stabilize the bottle longitudinally or axially therewithin. The handle which is affixed to the lid is designed to allow the carrier/cooler to be easily carried, or it can be held by one hand to act as a fulcrum while a beverage is dispensed from the bottle.

DETAILED DESCRIPTION OF THE PREFERRED EMBODIMENT AND OPERATION OF THE INVENTION

Figure 1:
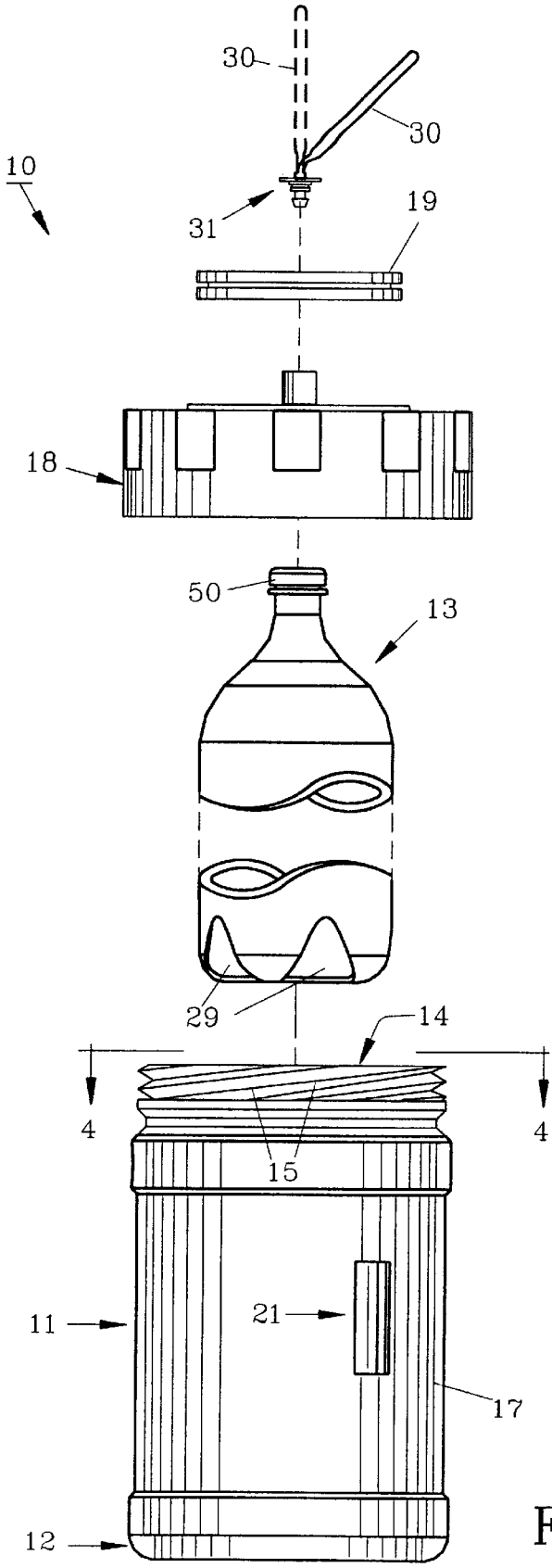
FIG. 1 demonstrates an exploded elevational view of the bottle carrier/cooler of the invention with a typical two liter beverage bottle.
Figure 4:
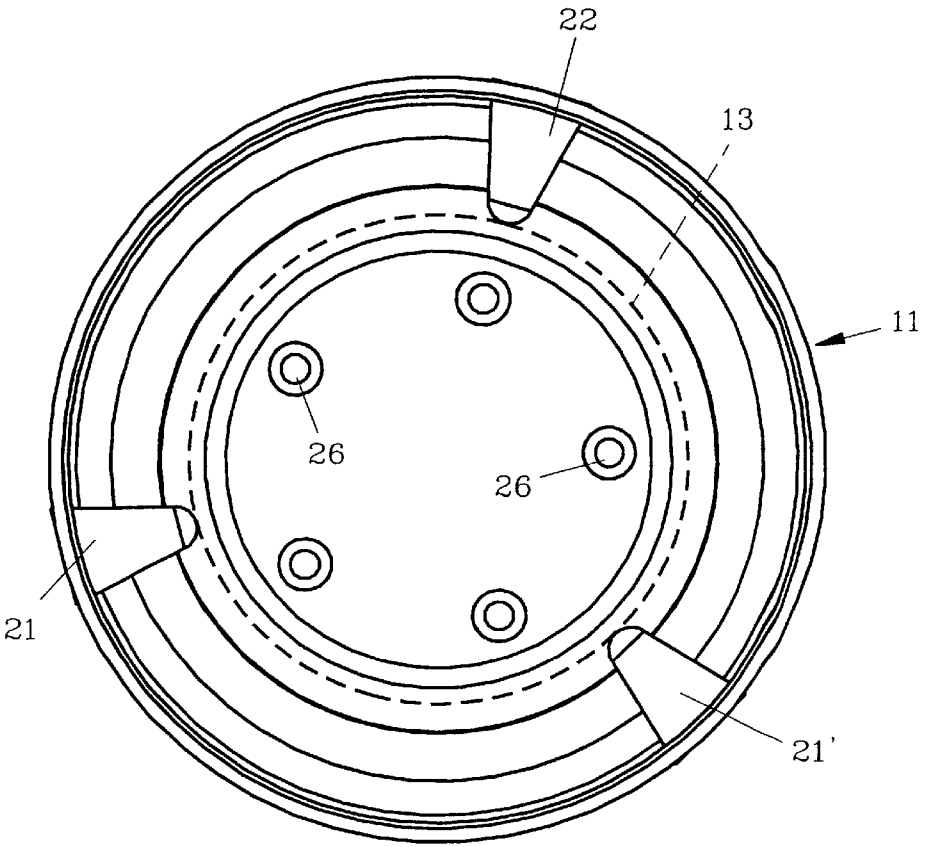
FIG. 4 depicts a top view of the body of the carrier/cooler as along lines 4—4 of FIG. 1.

For a better understanding of the invention and its operation, turning now to the drawings, FIG. 1 shows a preferred bottle carrier/cooler 10 in exploded fashion having body 11 integrally formed such as by molding techniques with bottom 12. Body 11 is sized to accommodate a typical two liter plastic soft drink bottle 13, (seen fragmented) although as would be understood, carrier/cooler 10 could be sized to accommodate one liter bottles or other size bottles as desired. Body 11 includes an upper, open end 14 having a series of threads 15 for engaging threads 16 on lid 18 (seen in FIG. 6). Body 11 includes sidewall 17 with finger detents 21, 21' formed therein as shown in FIG. 4, and conical detent 22. Detents 21, 21' and 22 stabilize bottle 13 by contact at three points along the bottle circumference as shown in ghost fashion in FIG. 4. Thus, by stabilizing and aligning bottle 13, ice 25 or other refrigerants as shown in FIG. 7 can be so placed to provide even, balanced cooling along the sides of bottle 13.

Figure 2:
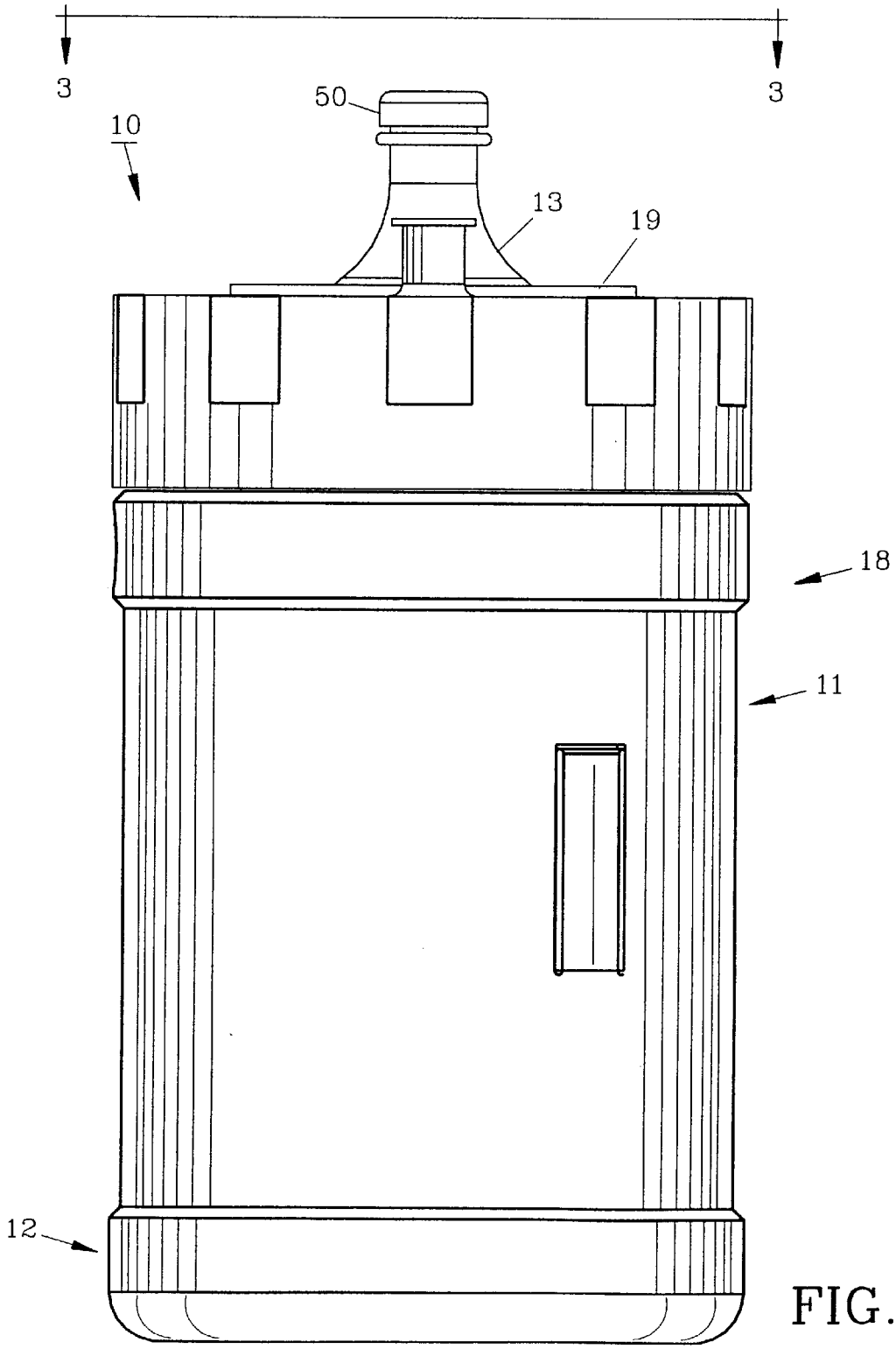
FIG. 2 illustrates the carrier/cooler seen in FIG. 1 in an assembled, enlarged side view with the handle removed for clarity.
Figure 7:
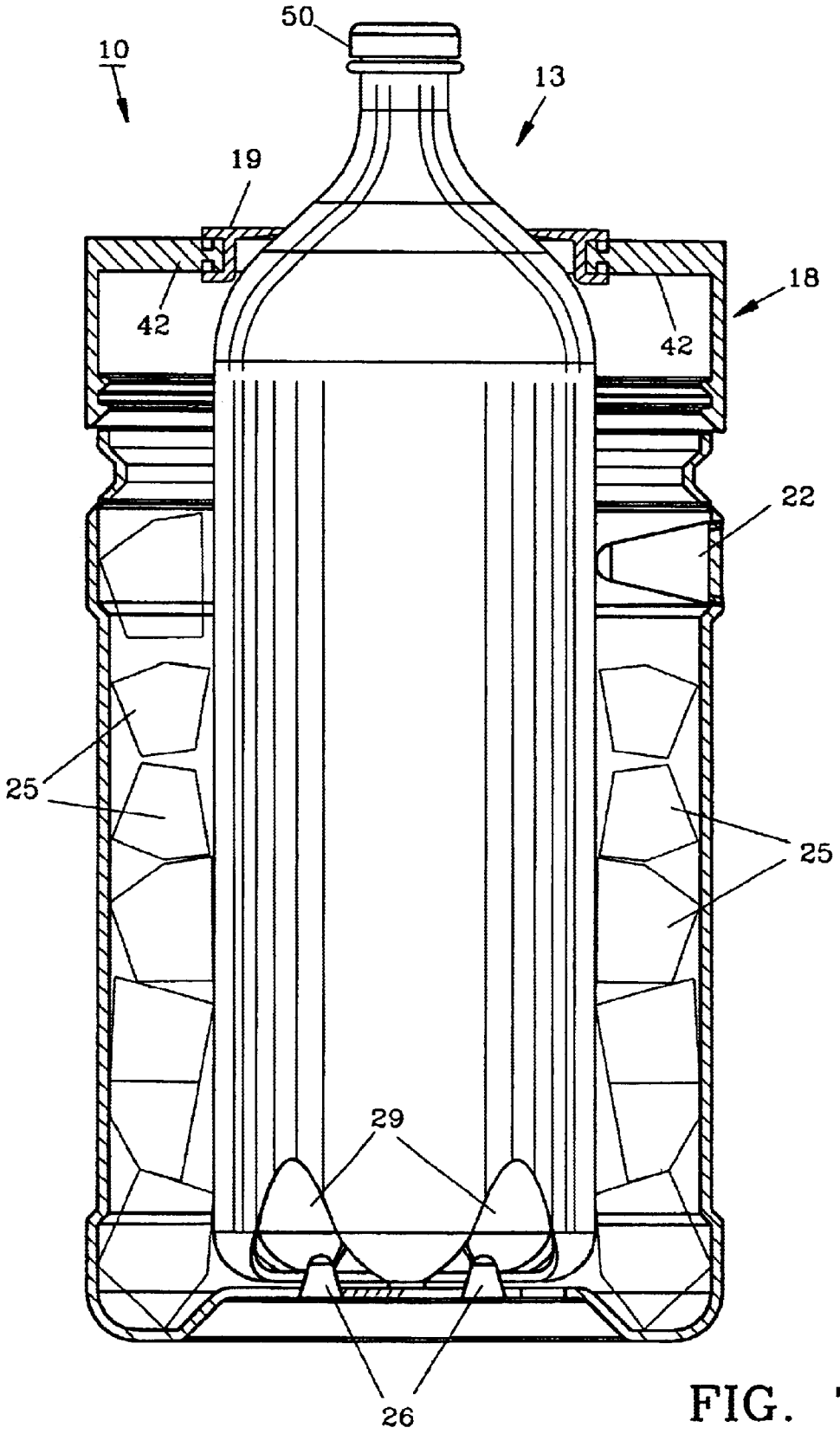
FIG. 7 demonstrates a cross section elevational view of the carrier/cooler with the bottle and ice therein and with the handle removed for clarity.

Bottom 12 of body 11 includes a plurality of upward projections 26 formed therealong during molding as shown in FIGS. 4 and 7 which matingly engage indentions 29 in the bottom of bottle 13 (shown in FIG. 1). Projections 26 along with lid 18 and seal 19 stabilize bottle 13 longitudinally within carrier/cooler 10, whereas detents 21, 21' and 22 stabilize bottle 13 radially therein. Seal 19 also prevents liquid such as from melted ice refrigerant 25 within carrier/cooler 10 from spilling or draining therefrom such as when cap 50 of bottle 13 is removed and carrier/cooler 10 is tilted for pouring purposes. As shown in FIGS. 2 and 7, bottle 13 has its neck portion exposed whereby bottle cap 50 can easily be removed, beverage poured therefrom and bottle cap 50 replaced without disturbing the assembly integrity of carrier/cooler 10.

Figure 5:
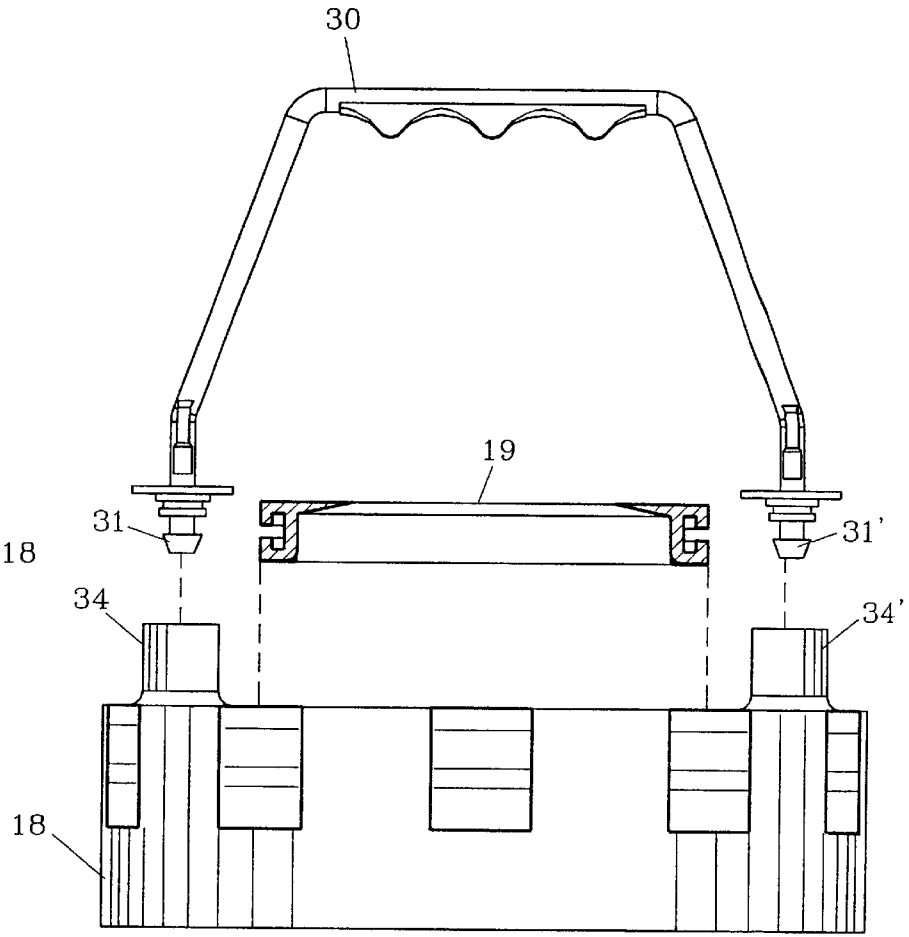
FIG. 5 features an enlarged view of the lid with the handle and seal exploded therefrom.
Figure 6:
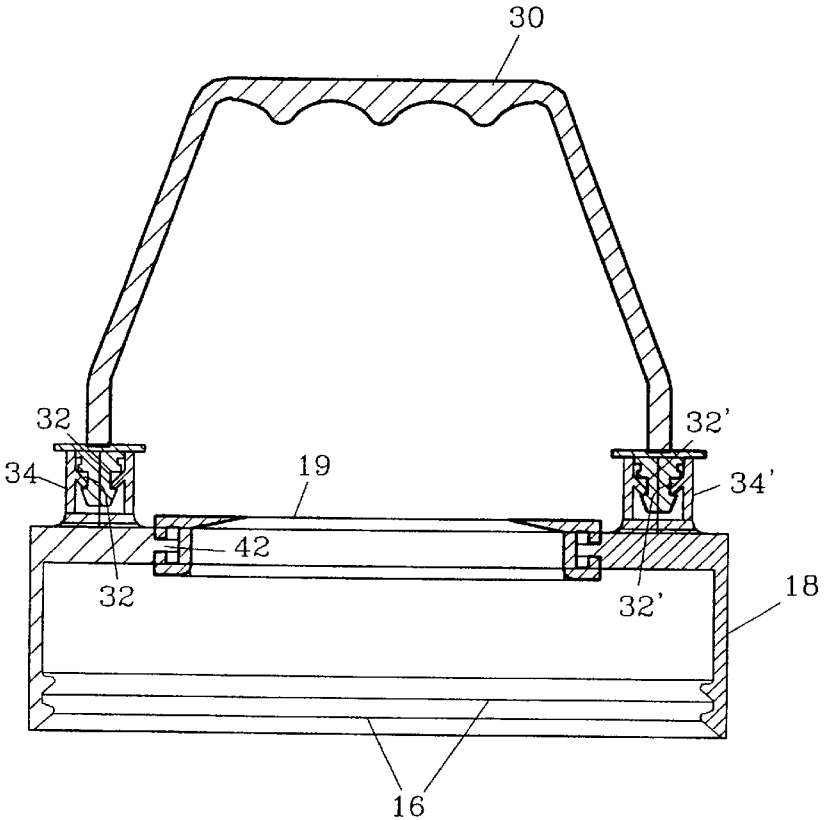
FIG. 6 pictures a cross sectional side view of the handle engaged with the lid as seen in FIG. 5.

Handle 30 shown in FIGS. 1, 5 and 6 has terminal ends 31, 31' which fit into cylindrically shaped handle ports 34, 34' which contain fingers 32, 32' as shown in FIGS. 5 and 6 formed from a flexible, plastic material such as by injection molding. Terminal handle ends 31, 31' "snap" to engage fingers 32, 32' as shown in FIG. 6 to maintain handle 30 therein. Handle 30 is flexible and in its dormant posture shown in FIG. 1 is positioned at an approximate 45° angle relative to the top surface of lid 18. Upon lifting, handle 30 is raised to a substantially vertical position (90° to the top surface of lid 18) as shown in dotted lines in FIG. 1. This motion by flexible handle 30 allows carrier/cooler 10 to be packaged for retail sales in a compact fashion yet is convenient during lifting, pouring or the like.

Figure 3:
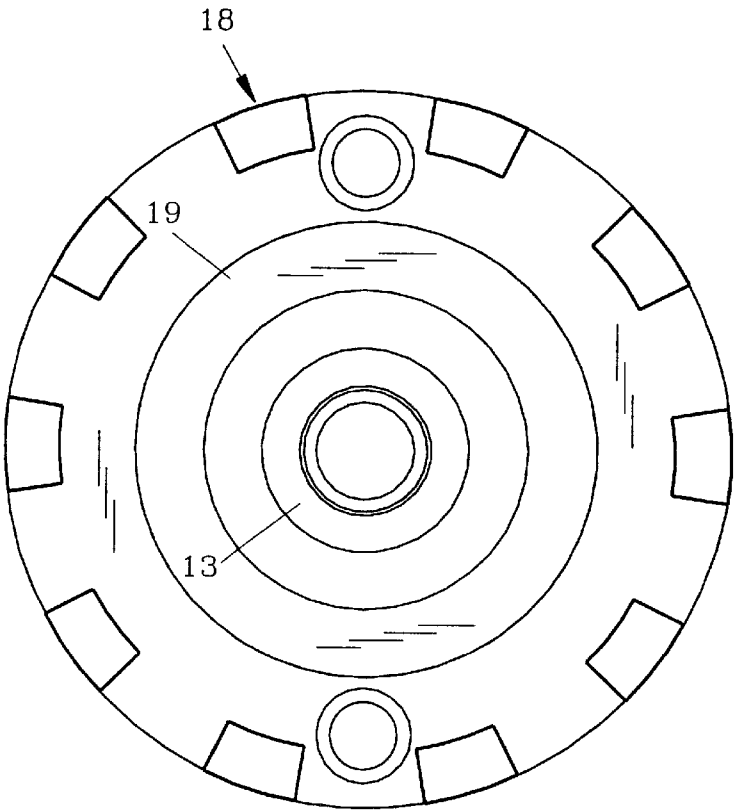
FIG. 3 shows a top view of the carrier/cooler as seen in FIG. 2 along lines 3—3.

FIG. 5 further demonstrates the use of preferred seal 19 connected to lid 18, also shown in FIGS. 1 and 7. Other seals can likewise be used, although such is not preferred. Seal 19 is formed from an elastomeric material such as a rubber, a polymeric material or otherwise. Seal 19 contacts the neck or shoulder of bottle 13 as shown in FIG. 3 and is tightened thereon by lid 18. When so tightened, seal 19 prevents liquids, melted ice or the like from dripping as carrier/cooler 10 is tilted for pouring purposes. As also seen in FIGS. 6 and 7, lid 18 includes top ring 42 which is engaged by c-shaped seal 19.

The illustrations and examples provided herein are for explanatory purposes and are not intended to limit the scope of the appended claims.

I claim:

1. A bottle carrier comprising: a body, a lid, said lid releasably joined to said body, said body defining a pair of finger detents, and a conical detent, said finger detents to allow secure finger gripping of the carrier, said finger detents and said conical detent for stabilization of a bottle therewithin, said lid defining an opening to allow the neck of the bottle to pass therethrough and a seal, said seal affixed to said lid for engaging the bottle.

2. The bottle carrier of claim 1 wherein said lid is threadably affixed to said body.

3. The bottle carrier of claim 1 wherein said seal is formed from an elastomeric material.

4. The bottle carrier of claim 1 further comprising a handle, said handle affixed to said lid.

5. The bottle carrier of claim 4 wherein said handle is flexible.

6. A bottle carrier to allow the user to pour from the bottle while the bottle remains in the carrier, comprising: a body, said body defining a bottom, sidewalls, a pair of finger detents, a conical detent and an open end opposite said bottom, a lid, said lid releasably affixed to said open end, said lid defining a central opening to allow the neck of the bottle to pass therethrough and said finger detents to allow gripping of said carrier while said finger detents and said conical detent contact the bottle to stabilize the bottle therewithin.

7. The bottle carrier of claim 6 wherein said body is sized to contain a refrigerant and a bottle positioned therein.

8. The carrier of claim 6 wherein said body is molded from plastic.

9. The bottle carrier of claim 6 wherein said lid and said body threadably connect.

10. The bottle carrier of claim 6 further comprising a flexible handle, said handle attached to said lid.

11. The bottle carrier of claim 10 wherein said handle is molded from a polymeric material.

12. The bottle carrier of claim 6 wherein said bottom defines a plurality of upward projections.

13. A bottle carrier comprising: a body, said body sized to contain a beverage bottle, said body defining an opening, said opening to allow said bottle to extend throughout for dispensing the bottle contents, said body defining a pair of finger detents and a conical detent, said finger detents to allow gripping of the carrier while said finger detents and said conical detent contact a bottle therein for stabilizing purposes, and a seal, said seal defining a c-shaped cross section, said seal for engaging said bottle proximate said opening.

14. The bottle carrier of claim 13 further comprises a handle, said handle attached to said body.

* * * * *